US010801745B2

(12) United States Patent
Rousseau

(10) Patent No.: US 10,801,745 B2
(45) Date of Patent: Oct. 13, 2020

(54) DAMPER, INSTALLATION KIT FOR DAMPER AND DAMPER KIT INSTALLATION METHOD FOR COOKING OPERATIONS

(71) Applicant: INTELLINOX INC., Québec (CA)

(72) Inventor: Mario Rousseau, Québec (CA)

(73) Assignee: INTELLINOX INC., Québec, Québec (CA)

( * ) Notice: Subject to any disclaimer, the term of this patent is extended or adjusted under 35 U.S.C. 154(b) by 693 days.

(21) Appl. No.: 15/026,183

(22) PCT Filed: Oct. 1, 2014

(86) PCT No.: PCT/CA2014/050942
§ 371 (c)(1),
(2) Date: Mar. 30, 2016

(87) PCT Pub. No.: WO2015/048895
PCT Pub. Date: Apr. 9, 2015

(65) Prior Publication Data

US 2016/0231019 A1 Aug. 11, 2016

Related U.S. Application Data

(60) Provisional application No. 61/885,238, filed on Oct. 1, 2013.

(51) Int. Cl.
*F24F 13/14* (2006.01)
*F24F 13/02* (2006.01)
(Continued)

(52) U.S. Cl.
CPC ..... *F24F 13/1413* (2013.01); *F24C 15/2021* (2013.01); *F24C 15/2042* (2013.01);
(Continued)

(58) Field of Classification Search
CPC ..... F24F 13/1413; F24F 13/0245; F24F 13/0254; F24F 13/1486; F24F 13/075;
(Continued)

(56) References Cited

U.S. PATENT DOCUMENTS 493,363 A * 3/1893 Lang ..... F23L 13/02 126/292
1,946,008 A * 2/1934 White ..... F24B 1/1895 126/538
(Continued)

FOREIGN PATENT DOCUMENTS

EP 0 794 386 A2 9/1997
FR 2 509 826 A1 1/1983
(Continued)

OTHER PUBLICATIONS

Kiguchi et al., JPH3-207957A English machine translation, Sep. 11, 1991.*
(Continued)

*Primary Examiner* — Edelmire Bosques
*Assistant Examiner* — Phillip Decker
(74) *Attorney, Agent, or Firm* — Merchant & Gould P.C.

(57) ABSTRACT

A damper, damper kit and method are for installing a damper in a duct defining a gas conduit. The damper kit includes a first aperture closing unit engageable with at least one conduit wall and configured to close a first aperture when engaged therewith and including a shaft receiving section opened in the gas conduit. The damper kit has a second aperture closing unit engageable with the at least one conduit wall and including a shaft receiving section opened in the gas conduit. The damper kit includes a damper having at least one shaft with a first section insertable in the shaft receiving section of the first aperture closing unit and a second section insertable in the shaft receiving section of the
(Continued)

second aperture closing unit and extending past the at least one conduit wall through the second aperture closing unit.

11 Claims, 3 Drawing Sheets

(51) Int. Cl.
*F24C 15/20* (2006.01)
*F24B 1/189* (2006.01)

(52) U.S. Cl.
CPC ..... *F24C 15/2071* (2013.01); *F24F 13/0245* (2013.01); *F24F 13/0254* (2013.01); *F24F 13/14* (2013.01); *F24F 13/1486* (2013.01); *F24B 1/1895* (2013.01); *F24F 2013/1433* (2013.01)

(58) Field of Classification Search
CPC F24F 13/12; F16C 17/26; F16C 23/02; F16C 17/00; F16C 33/02; F16C 33/06; F16C 33/08
USPC ..... 454/334
See application file for complete search history.

(56) References Cited

U.S. PATENT DOCUMENTS 2,005,896 A * 6/1935 Hurt ..... E01C 19/2005 239/650
2,091,019 A * 8/1937 Smith ..... F24F 1/04 454/203
2,174,888 A * 10/1939 Klann ..... F24B 1/1895 126/536
2,323,038 A 6/1943 Heasley et al.
2,837,991 A * 6/1958 De Roo ..... F24F 13/1413 454/292
3,022,671 A * 2/1962 Wappner ..... G01K 1/14 374/194
3,313,226 A * 4/1967 Johnson ..... F24F 13/15 454/319
3,377,047 A * 4/1968 Scholl ..... F16K 1/22 251/175
3,502,380 A * 3/1970 Adinoff ..... F16C 33/20 384/299
3,547,152 A * 12/1970 Hess ..... F24F 13/10 137/601.06
3,721,077 A * 3/1973 Van Der Lely ..... A01B 51/00 56/15.6
3,830,146 A * 8/1974 Kaiser ..... A01K 1/0064 160/1
4,355,567 A * 10/1982 Josephson ..... F24F 13/1486 126/285 R
4,503,755 A * 3/1985 Nordquist ..... F24F 13/1486 16/380
4,623,810 A * 11/1986 Smith ..... F16C 35/02 310/43
4,744,290 A * 5/1988 Josephson ..... F24F 13/1486 126/291
4,760,773 A * 8/1988 Pezzulli ..... F24F 7/02 454/348
4,831,777 A * 5/1989 Johnson, Jr. ..... E06B 9/02 160/228
5,096,156 A 3/1992 Wylie et al.
5,273,369 A * 12/1993 Strobl ..... F16C 23/045 384/206
5,447,544 A * 9/1995 Birdwell ..... B01D 46/0005 55/472
5,567,998 A * 10/1996 Ineson ..... F16C 33/08 310/90
5,921,277 A * 7/1999 Bernal ..... F16K 27/0218 137/315.24
6,237,630 B1 * 5/2001 Stone ..... F16K 17/383 137/601.12
7,360,837 B1 * 4/2008 Liu ..... A47C 7/402 297/353
7,644,711 B2 * 1/2010 Creel ..... F24B 1/192 126/21 R
2005/0152627 A1 * 7/2005 Ku ..... F16C 17/02 384/276
2008/0116288 A1 * 5/2008 Takach ..... F24F 13/14 236/49.5
2009/0093210 A1 4/2009 Livchak et al.
2012/0108159 A1 * 5/2012 Votaw ..... F24F 13/1413 454/333
2013/0337736 A1 12/2013 Marak et al.
2015/0140922 A1 * 5/2015 Babur ..... F24F 13/12 454/298

FOREIGN PATENT DOCUMENTS

JP H03-207957 A 9/1991
JP 2004144389 A 5/2004
JP 2005-249368 A 9/2005
JP 2012211711 A 11/2012

OTHER PUBLICATIONS

Avallone, et al, (Marks' Standard Handbook for Mechanical Engineers, 1987, McGraw-Hill, Ninth Edition, p. 6-64 (Year: 1987).*
Extended European Search Report for corresponding European Patent Application No. 14850158.8 dated May 9, 2017, 7 pages.
International Search Report for corresponding International Patent Application No. PCT/CA2014/050942 dated Dec. 15, 2014, 3 pgs.

* cited by examiner

12

DAMPER, INSTALLATION KIT FOR DAMPER AND DAMPER KIT INSTALLATION METHOD FOR COOKING OPERATIONS

CROSS REFERENCE TO RELATED APPLICATION

This application is a National Stage Application of PCT/CA2014/050942, filed Oct. 1, 2014, which claims the benefit under 35 U.S.C. § 119(e) of U.S. provisional patent application No. 61/885,238 which was filed on Oct. 1, 2013 and which applications are incorporated herein by reference. To the extent appropriate, a claim of priority is made to each of the above disclosed applications.

FIELD OF THE INVENTION

The present invention relates to the field of dampers. More particularly, it relates to a damper for a duct used in commercial cooking operations as well as an installation kit and a method of installation for installing the same.

BACKGROUND

Dampers are widely used in ducts of commercial kitchens in order to regulate the airflow therein. For safety issues, such dampers must however meet specific requirements in order to be installed in such ducts. For example, the section of a duct in which a damper is installed must be able to withstand high temperatures and specific fire ratings. Consequently, the holes and openings in the duct required for the installation or operation of the dampers must be closed or sealed, in order to respect existing security standards such as NFPA 96 *Standard for Ventilation Control and Fire Protection of Commercial Cooking Operations.*

Typically, known dampers are therefore comprised within a damper assembly including a non-moving frame or a non-moving plate mountable to a duct and to which the damper is connected. This usually means that, in order to install such a damper assembly to an existing duct, a section of the existing duct must be cut out and the damper assembly must be inserted into the cut-out section and welded in place. Moreover, given that existing ducts of commercial kitchens usually have a greasy interior surface, degreasing of the interior surface is usually required in order to remove any grease which can create fire hazard during the welding stage. The above described procedure is time consuming and greatly increases installation costs of dampers to existing ducts.

In view of the above, there is a need for an improved damper, installation kit for damper and method of installation which would be able to overcome, or at least minimize, some of the above-discussed prior art concerns.

SUMMARY OF THE INVENTION

According to a general aspect, there is provided a damper kit for installing a damper in a duct having at least one conduit wall and defining a gas conduit, the at least one conduit wall having a first aperture and a second aperture extending through the at least one conduit wall. The damper kit comprises a first aperture closing unit engageable with the at least one conduit wall and configured to close the first aperture when engaged with the at least one conduit wall and comprising a shaft receiving section opened in the gas conduit. The damper kit also comprises a second aperture closing unit engageable with the at least one conduit wall and comprising a shaft receiving section opened in the gas conduit. The damper kit also comprises a damper having at least one shaft with a first section insertable in the shaft receiving section of the first aperture closing unit and a second section insertable in the shaft receiving section of the second aperture closing unit. The at least one shaft extends past the at least one conduit wall through the second aperture closing unit, outwardly of the gas conduit, and the second aperture closing unit is configured to close the second aperture when engaged with the at least one conduit wall, with the second section of the shaft inserted in the shaft receiving section.

In an embodiment, the first aperture closing unit comprises a plug including a peripheral wall defining a shaft receiving cavity of the shaft receiving section and an end wall extending inwardly from the peripheral wall, at a closed end of the plug.

In an embodiment, the plug further comprises a peripheral flange extending peripherally outwardly at an open end of the plug and engageable to an inner surface of the at least one conduit wall, around the first aperture, and the first aperture closing unit further comprises a securing member screwable onto an outer surface of the peripheral wall of the plug, outwardly of the duct.

In an embodiment, the damper comprises at least a first damper blade and a second damper blade slidably engageable with one another and configurable in at least two configurations.

In an embodiment, the first damper blade comprises at least one of a male member and a female member and the second damper blade comprises at least one of the other one of the male member and the female member. The at least one of the male and the female members are slidably engageable together.

In an embodiment, each one of the first damper blade and the second damper blade comprises a protruding male member and each one of the first damper blade and the second damper blade comprises an elongated slot. The protruding male member are insertable and slidable in the elongated slot of the other one of the first damper blade and the second damper blade.

In an embodiment, the first damper blade comprises a first shaft including the first section insertable in the shaft receiving section of the first aperture closing unit and the second damper blade comprises a second shaft including the second section insertable in the shaft receiving section of the second aperture closing unit.

In an embodiment, the first damper blade and the second damper blade are selectively configurable in a contracted configuration and a plurality of extended configurations and are securable in one of the plurality of extended configurations.

In an embodiment, the second aperture closing unit comprises an inner member superposable to an inner surface of the at least one conduit wall to surround and partially cover the second aperture and an outer member superposable to an outer surface of the at least one conduit wall to surround the second aperture, each one of the inner member and the outer member comprising a shaft receiving aperture extending therethrough.

In an embodiment, the inner member comprises a peripheral wall defining a shaft receiving cavity of the shaft receiving section. The shaft receiving cavity is opened at both ends and a peripheral flange extends peripherally outwardly at a first one of the opened ends of the shaft receiving cavity. The peripheral flange is engageable to an inner surface of the at least one conduit wall, around the second aperture. The outer member is screwable onto an outer surface of the peripheral wall, outwardly of the gas conduit.

In an embodiment, the at least one shaft also extends past the at least one conduit wall through the first aperture closing unit, outwardly of the gas conduit.

In an embodiment, the first aperture closing unit comprises an inner member superposable to an inner surface of the at least one conduit wall to surround and partially cover the first aperture and an outer member superposable to an outer surface of the at least one conduit wall to surround the first aperture, each one of the inner member and the outer member comprising a shaft receiving aperture extending therethrough.

In an embodiment, the at least one shaft of the damper is rotatably engaged with the first aperture closing unit and the second aperture closing unit.

In an embodiment, the damper kit further comprises an actuation system operatively connectable to a section of the at least one shaft of the damper extendable through the second aperture closing unit.

In an embodiment, the first aperture and the second aperture are substantially aligned and defined on opposed sides of the at least one conduit wall.

In an embodiment, the duct is a duct used in cooking operations.

According to another general aspect, there is also provided a damper kit for installing a damper in a duct having at least one conduit wall defining a gas conduit, the at least one conduit wall having a first aperture and a second aperture substantially aligned with and opposed to the first aperture, the first and second apertures extending through the at least one conduit wall. The damper kit comprises a first aperture closing unit engageable with the at least one conduit wall, the first aperture closing unit being configured to close the first aperture when engaged with the at least one conduit wall and comprising a shaft receiving section opened in the gas conduit. The damper kit also comprises a damper having at least one shaft with a first section insertable in the shaft receiving section of the first aperture closing unit and a second section extendable through the second aperture. The damper kit further comprises a second aperture closing unit engageable with the at least one conduit wall and comprising a shaft receiving section opened in the conduit, the second aperture closing unit is configured to close the second aperture with a section of the at least one shaft of the damper extending through the shaft receiving section, when engaged to the at least one conduit wall.

In an embodiment, the first aperture closing unit comprises a plug including a peripheral wall defining a shaft receiving cavity of the shaft receiving section and an end wall extending inwardly from the peripheral wall, at a closed end of the plug.

In an embodiment, the plug further comprises a peripheral flange extending peripherally outwardly at an open end of the plug and engageable to an inner surface of the at least one conduit wall, around the first aperture, and the first aperture closing unit further comprises a securing member screwable onto an outer surface of the peripheral wall of the plug, outwardly of the duct.

In an embodiment, the damper comprises at least a first damper blade and a second damper blade slidably engageable with one another and configurable in at least two configurations.

In an embodiment, the first damper blade comprises at least one of a male member and a female member and the second damper blade comprises at least one of the other one of the male member and the female member. The at least one of the male and the female members are slidably engageable together.

In an embodiment, each one of the first damper blade and the second damper blade comprises a protruding male member and each one of the first damper blade and the second damper blade comprises an elongated slot. The protruding male member is insertable and slidable in the elongated slot of the other one of the first damper blade and the second damper blade.

In an embodiment, the first damper blade comprises a first shaft including the first section insertable in the shaft receiving section of the first aperture closing unit and the second damper blade comprises a second shaft including the second section insertable in the shaft receiving section of the second aperture closing unit.

In an embodiment, wherein the first damper blade and the second damper blade are selectively configurable in a contracted configuration and a plurality of extended configurations and are securable in one of the plurality of extended configurations.

In an embodiment, the second aperture closing unit comprises an inner member superposable to an inner surface of the at least one conduit wall to surround and partially cover the second aperture and an outer member superposable to an outer surface of the at least one conduit wall to surround the second aperture. Each one of the inner member and the outer member comprises a shaft receiving aperture extending therethrough.

In an embodiment, the inner member comprises a peripheral wall defining a shaft receiving cavity of the shaft receiving section. The shaft receiving cavity is opened at both ends and a peripheral flange extends peripherally outwardly at a first one of the opened ends of the shaft receiving cavity. The peripheral flange is engageable to an inner surface of the at least one conduit wall, around the second aperture. The outer member is screwable onto an outer surface of the peripheral wall, outwardly of the gas conduit.

In an embodiment, the at least one shaft of the damper is rotatably engaged with the first aperture closing unit and the second aperture closing unit.

In an embodiment, the damper kit further comprises an actuation system operatively connectable to a section of the at least one shaft of the damper extendable through the second aperture closing unit.

In an embodiment, the duct is a duct used in cooking operations.

According to another general aspect, there is also provided a damper for an existing duct having at least one conduit wall defining a gas conduit, the at least one conduit wall including a first aperture closed by a first aperture closing unit having a shaft receiving section opened in the gas conduit and a second aperture substantially aligned with and opposed to the first aperture and closed by a second aperture closing unit when the damper is mounted. The damper comprises at least a first damper blade and a second damper blade slidably engageable with one another and at least one shaft mounted to the first damper blade and the second damper blade. The at least one shaft has a first section extending from the first damper blade and a second section extending from the second damper blade. The first section and the second section of the at least one shaft are respectively insertable in the shaft receiving section of the first aperture closing unit and the second aperture closing unit.

In an embodiment, the second section of the at least one shaft extends through the second section extendable through the second aperture closing unit and closes the second aperture in combination with the second aperture closing unit.

In an embodiment, the first damper blade comprises at least one of a male member and a female member and the second damper blade comprises at least one of the other one of the male member and the female member. The at least one of the male and the female members are slidably engageable together.

In an embodiment, the first damper blade comprises a first shaft including the first section insertable in the shaft receiving section of the first aperture closing unit and the second damper blade comprises a second shaft including the second section extendable through the second aperture closing unit.

In an embodiment, the first damper blade and the second damper blade are configurable between a contracted configuration and a plurality of extended configurations and are securable in one of the plurality of extended configurations.

In an embodiment, the damper is configurable in a plurality of modulating configurations.

In an embodiment, the damper further comprises an actuation system operatively connectable to the second section of the at least one shaft and actuable to rotate the at least one shaft to configure the damper in the plurality of modulating configurations.

In an embodiment, the duct is a duct used in cooking operations.

According to another general aspect, there is provided a method for installing a damper having at least one shaft in a duct having at least one conduit wall defining a gas conduit. The method comprises the steps of: making a first aperture and a second aperture in the at least one conduit wall of the duct; mounting a first aperture closing unit to the at least one conduit wall, the first aperture closing unit closing the first aperture and providing a shaft receiving section; inserting at least one shaft of the damper in the gas conduit, the at least one shaft having a first section engaged in the shaft receiving section of the first aperture closing unit and a second section extending through the second aperture and outside of the gas conduit; and mounting a second aperture closing unit to the at least one conduit wall, the second aperture closing unit closing the second aperture, with the section of the at least one shaft of the damper extending therethrough.

In an embodiment, the first aperture closing unit comprises a plug and a securing member. The plug includes the shaft receiving section defining a shaft receiving cavity and a peripheral flange extending outwardly from the shaft receiving section at an open end of the shaft receiving cavity. The shaft receiving section has an outer surface. The step of securing the first aperture closing unit to the at least one conduit wall comprises: inserting the plug in the first aperture; abutting the peripheral flange of the plug against an inner surface of the at least one conduit wall, around the first aperture; and engaging the securing member to the outer surface of the shaft receiving section, outwardly of the duct.

In an embodiment, the step of engaging the securing member to the shaft receiving section comprises screwing the securing member to the outer surface of the shaft receiving section.

In an embodiment, the step of inserting the at least one shaft of the damper in the gas conduit comprises: introducing the damper in the gas conduit in a contracted configuration; inserting the second section of the at least one shaft of the damper in the second aperture; and expanding the damper in an operative configuration to engage the first section of the at least one shaft with the shaft receiving section of the first aperture closing unit and extend the at least one shaft through the second aperture, outwardly past the at least one conduit wall.

In an embodiment, the second aperture closing unit comprises an inner member and an outer member and the step of securing the second aperture closing unit to the at least one conduit wall comprises: inserting the inner member in the second aperture; abutting the peripheral flange of the inner member against an inner surface of the at least one conduit wall, around the second aperture; and engaging the outer member to the inner member, outwardly of the duct.

In an embodiment, the method further comprises the step of connecting an actuation system to the second section of the at least one shaft extending outwardly past the at least one conduit wall. The actuation system is operative to rotate the at least one shaft and rotate the damper between a plurality of modulating configurations.

In an embodiment, making the first aperture and the second aperture in the at least one conduit wall of the duct comprises substantially aligning the first aperture and the second aperture on opposed sides of the at least one conduit wall.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the damper and damper kit and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, can be used for the damper and damper kit, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
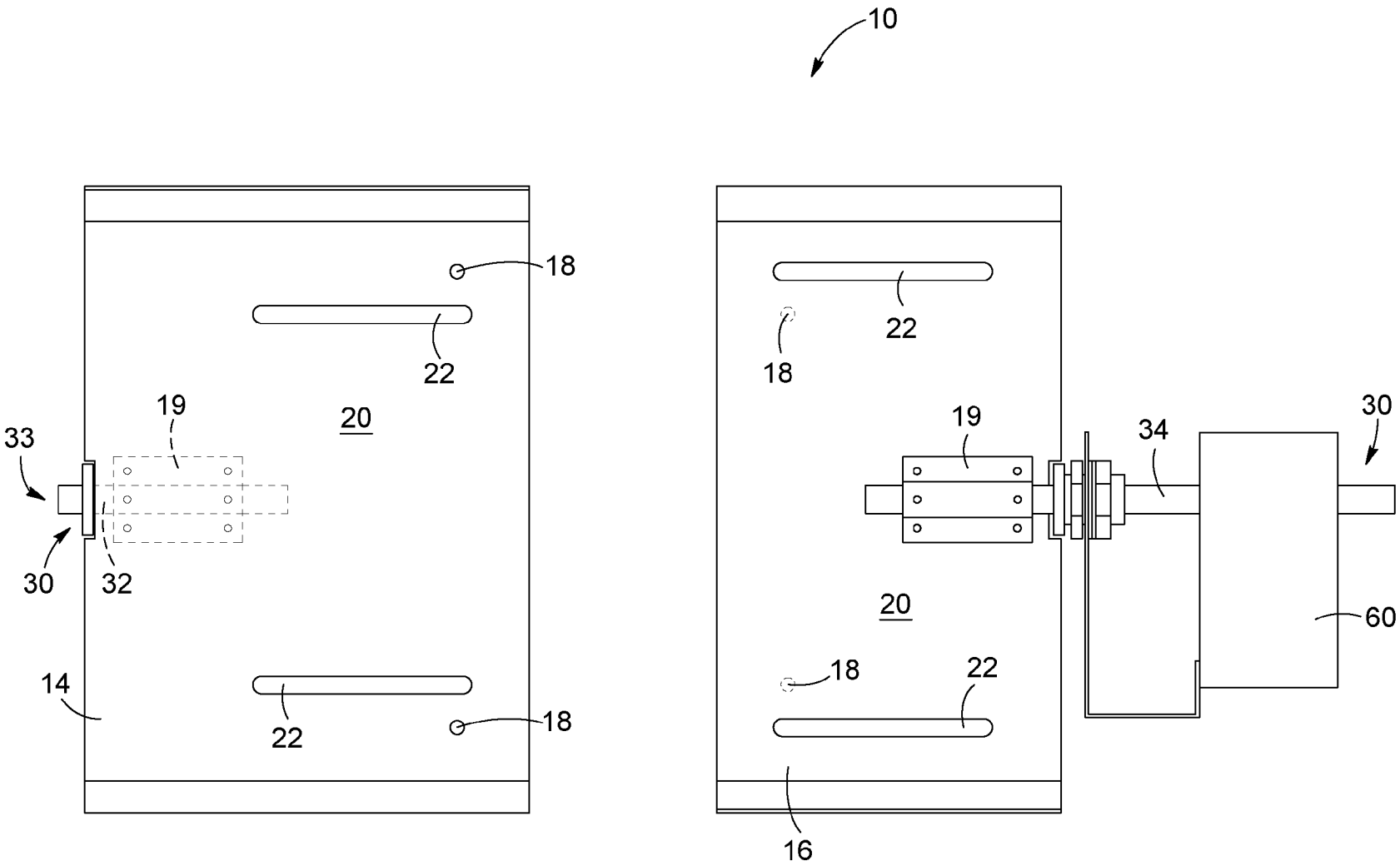
FIG. 1 is a schematic front elevation view of a damper according to an embodiment, the damper being shown in a disassembled configuration.
Figure 2:
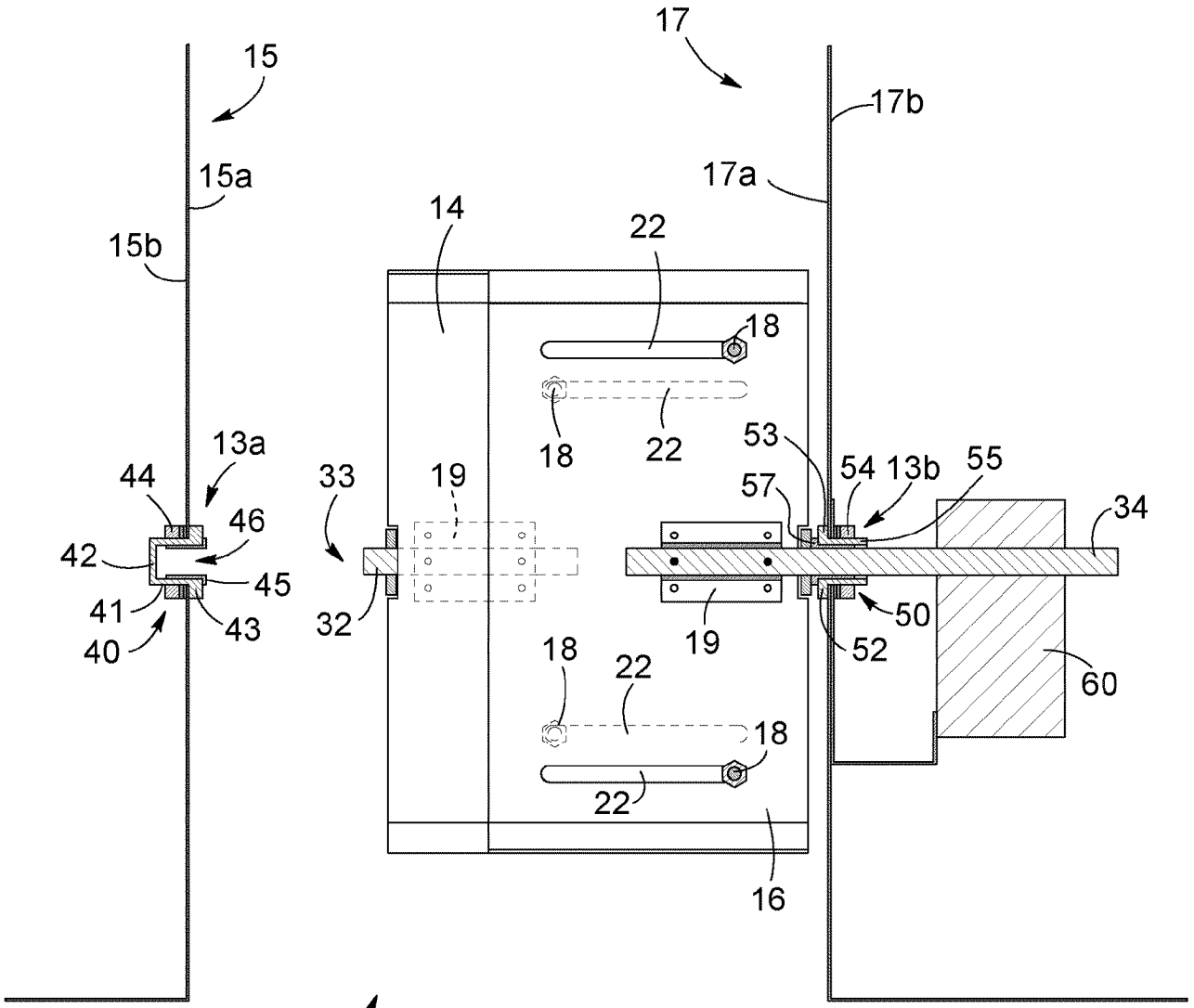
FIG. 2 is a schematic cross sectional front view of the damper of FIG. 1 shown in an assembled inoperative configuration and being installed in a duct.
Figure 3:
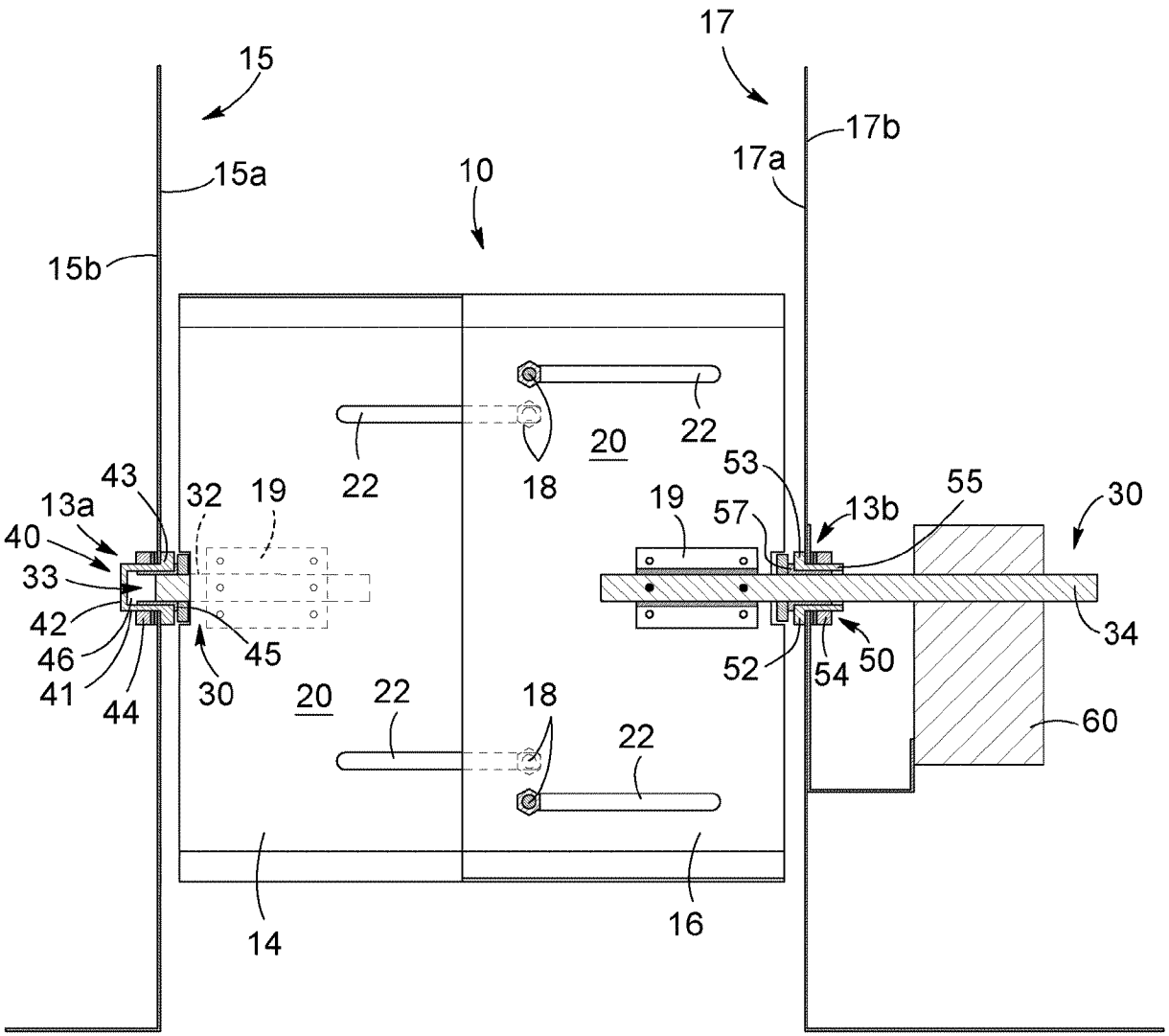
FIG. 3 is a schematic cross-sectional front view of the damper of FIG. 2 shown in an operative configuration.

Referring generally to FIGS. 1 to 3, in accordance with an embodiment, there is provided a damper 10 to be installed in a pre-existing duct 12 of a commercial kitchen space (not shown) and used in cooking operations. The duct 12 includes at least one conduit wall defining a gas conduit therebetween. In the embodiment shown, the duct 12 is of rectangular shape and includes two pairs of opposed walls, however one skilled in the art will understand that, in an alternative embodiment (not shown) the duct can be of circular shape and include a single wall or of polygonal shape with a plurality of walls.

As will be described below, in order to perform the installation of the damper 10, two apertures therethrough are required in the at least one wall of the pre-existing duct 12, i.e. the two apertures being through holes. In an embodiment, the apertures are made in opposed sides of the conduit wall(s). In the embodiment shown, a first aperture 13*a* is required in a first wall 15 of the duct 12 and a second aperture 13*b* is required in a second wall 17, opposite to the first wall 15. In an embodiment, the first aperture 13*a* and the second aperture 13*b* are substantially aligned with one another.

In an embodiment, a single damper 10 is used for regulating an airflow in the duct 12, the damper 10 being sized and shaped such as to cover substantially an entire section of the duct when positioned in a closed configuration, i.e. positioned substantially perpendicular to the direction of the airflow. Hence, one skilled in the art will understand that, for example, in an embodiment where the duct has a substantially circular shape, the damper 10 can have substantially curved shaped ends in order to cover substantially the entire section of the duct when positioned in the closed configuration, rather than the rectangular shape of the embodiment shown. In an alternative configuration, more than one adjacent damper 10 can cooperate for regulating the airflow in the duct 12, each one of the damper 10 covering a portion of the section of the duct when positioned in the closed position. In such an embodiment, each one of the damper 10 requires two apertures into opposite walls (or wall sections) of the pre-existing duct 12 for installation thereof. One skilled in the art will understand that, in operation, the multiple dampers 10 can move in parallel to one another, or in opposed directions.

In the embodiment shown, the damper 10 includes a first damper blade 14 and a second damper blade 16 slidably engageable with one another. In FIG. 1, the first damper blade 14 and the second damper blade 16 are shown in a disengaged configuration while in FIGS. 2 and 3, the first damper blade 14 and the second damper blade 16 are engaged and connected together. One skilled in the art will understand that, in an alternative embodiment, the damper 10 can however differ from the embodiment shown and can include either a single blade, or more than two blades connectable to one another.

In the embodiment shown, the first damper blade 14 and the second damper blade 16 include engageable male and female members which provide the slidable connection therebetween. As can be seen on the Figures, the male members are protruding male members, i.e. male members protruding from the surface 20 of the blades 14, 16, and include a combination of bolts and nuts 18, such as mechanical fasteners. The female members are elongated slots 22 formed in the surface 20 of each one of the damper blades 14, 16 for slidingly receiving the bolts 18*a* therein.

The above described assembly allows the assembled first damper blade 14 and second damper blade 16 to slide between a contracted configuration (see FIG. 2) and a plurality of extended configurations (see FIG. 3 for one embodiment of the extended configurations). In the contracted configuration, large sections of the damper blades 14, 16 overlap such that the width of the damper 10 is smaller than the width of the duct 12 in which the damper 10 is to be installed. In the extended configurations, the overlap between the damper blades 14, 16 is smaller. The overlap of the damper blades 14, 16 can be adjusted in a manner such that the width of the damper 10 substantially corresponds to the width of the duct 12 and, thereby, the damper 10 is configured in an operative configuration. Once the desired configuration is reached, the nuts are screwed on the corresponding bolts 18*a* to secure the first damper blade 14 against the second damper blade 16 by press fitting.

One skilled in the art will understand that, in an alternative embodiment, other assembly can be provided to allow the slidable connection between the damper blades 14, 16. Moreover, as previously mentioned, in an alternative embodiment, the damper 10 can also include more than two damper blades slidably engageable to one another.

The slidable connection between the first damper blade 14 and the second damper blade 16 and the corresponding transfer between the contracted configuration and the operative configuration is useful for installing the damper 10 inside a pre-existing duct 12, as will be described in more details below. However, it will be understood that, in an alternative embodiment (not shown), the damper 10 can include a single damper blade, i.e. the damper does not have a variable width as described above.

Still referring to FIGS. 1 to 3, the damper 10 further includes at least one shaft 30 for connecting the damper blades 14, 16 to the pre-existing duct 12. In the illustrated embodiment, a first shaft 32 is secured to the first damper blade 14 and projects laterally outwardly therefrom. A second shaft 34 is secured to the second damper blade 16 and projects laterally outwardly therefrom in a direction opposite from the first shaft 32 when the two damper blades 14, 16 are engaged together. In the embodiment shown, the first shaft 32 and the second shaft 34 are respectively secured onto the first damper blade 14 and the second damper blade 16 by attachment plates 19. Each attachment plate 19 maintains the respective shaft 32, 34 against the corresponding damper blade 14, 16 and prevents rotation therebetween. One skilled in the art will understand that, in alternative embodiments, different connections can be used for securing the shafts to the corresponding one of the damper blades. For example and without being limitative, the shafts can be integral to the damper blades or can be welded, screwed or riveted to the damper blades.

One skilled in the art will also understand that, in an alternative embodiment, a single shaft 30 can be provided. For example and without being limitative, the shaft 30 can have a specific outer shape and be slidable, clipable, or the like, into a matching shaft receiving section of the at least one damper blade, in order to prevent a rotating movement therebetween. For instance, the shaft 30 can have a triangular or square cross-section along a section thereof and the damper blades can include at least one receiving channel having a corresponding cross-section in which the section of shaft 30 is insertable.

In the embodiment shown, an end section 33 of the first shaft 32 is engageable in the first aperture 13*a* in the first wall 15 of the duct 12. For safety purposes, the first aperture 13*a* is required to be closed from the outside of the gas conduit of the duct 12. Hence, there is provided a first aperture closing unit 40, or first aperture closer, including a plug 41 having a shaft receiving section 42, or shaft receiver, with a peripheral wall and end wall extending inwardly from the peripheral wall, at a closed end of the plug 41. The peripheral wall and the end wall of the shaft receiver 42 of the plug 41 define a shaft receiving cavity 46 opened in the gas conduit. The plug 41 also includes a peripheral flange 43 extending outwardly from the peripheral wall, at an open end of the shaft receiving cavity 46, and surrounding same. The first aperture closer 40 is inserted in the first aperture 13*a* with the peripheral flange 43 abutting an inner face of the first wall 15. In the embodiment shown, the shaft receiving section 42 of the plug 41 protrudes outwardly of the duct 12. However, in an alternative embodiment, the shaft receiver 42 can at least partially extend in the duct 12. The shaft receiving cavity 46 of the plug 41 communicates with the duct 12 and the end section 33 of the first shaft 32 is engageable in the shaft receiving cavity 46 of the plug 41. As can be seen more clearly in FIGS. 2 and 3, the shaft receiving cavity 46 is sized and shaped for receiving the end section 33 of the first shaft 32 therein. The plug 41 is securable to the first wall 15 of the duct 12 for closing the first aperture 13*a* made therein, as will be described in more details below.

In the illustrated embodiment, in order to close the first aperture 13*a*, the plug 41 is inserted therein such that the peripheral flange 43 abuts an inner surface 15*a* of the first wall 15, around the first aperture 13*a*. The peripheral flange 43 is tightly pressed against the inner surface 15*a* of the first wall 15 to provide the desired closing of the first aperture 13*a*. More particularly, to provide the tight connection between the peripheral flange 43 and the inner surface 15*a* of the first wall 15, the first aperture closer 40 further comprises a securing member 44 or fastener. In the embodiment shown, at least a section of an outer surface of the peripheral wall of the shaft receiver 42 of the plug 41, which extends from the peripheral flange 43, comprises threads (not shown). The fastener 44 is screwed onto the outer surface of the shaft receiver 42 of the plug 41 from outside of the gas conduit of the duct 12, such as to press the peripheral flange 43 towards the inner surface 15*a* of the first wall 15.

In an embodiment, the first aperture closer 40 further includes a sleeve 45 extending into the shaft receiving cavity 46 of the plug 41. The first aperture closer sleeve 45 is shaped and sized to tightly fit around the end section 33 of the first shaft 32 to be received therein. In an embodiment, the first aperture closer sleeve 45 is made of wear resistant and/or low friction coefficient material, such as copper or the like. In an embodiment, a lubricant, such as grease or the like, can be provided inside the first aperture closer sleeve 45 to reduce friction between the inner surface of the sleeve and the end section 33 of the first shaft 32 received therein. In an alternative embodiment, the inner surface of the peripheral wall of the shaft receiver 42 can be made of or lined with a resistant and/or low friction coefficient material.

One skilled in the art will understand that, in an alternative embodiment, the configuration and shape of the plug 41 can vary from the embodiment shown. Moreover, in an alternative embodiment, a first aperture closing unit 40 different than a plug 41 can be used. In an embodiment, the first aperture closing unit 40 offers closure of the first aperture 13*a* in compliance with regulatory security standards, such as NFPA 96, and provides a shaft receiving section opened in the gas conduit for engagement with the end section 33 of the at least one shaft 30.

The second shaft 34 includes an end section projecting laterally from the second damper blade 16. The end section of the second shaft 34 is extendable through the second aperture 13*b* defined in the second wall 17 of the duct 12 and includes a section extending outside of the gas conduit of the duct 12. In an embodiment, a second aperture closing unit 50, or second aperture closer, is provided for closing the second aperture 13*b* with the second shaft 34 extending therethrough.

In an embodiment, the second aperture closing unit 50 comprises an inner member 52 and an outer member 54. The inner member 52 and the outer member 54 are respectively superposable to the inner surface 17*a* and the outer surface 17*b* of the second wall 17. When superposed to the second wall 17, the inner member 52 and the outer member 54 surround the second aperture 13*b*.

In an embodiment, similarly to the plug 41, the inner member 52 of the second aperture closing unit 50 includes a peripheral flange 53 and a shaft receiving section 55 extending from the peripheral flange 53. The shaft receiving section 55 comprises a peripheral wall defining a shaft receiving aperture opened at both ends, with one of the ends being substantially aligned with the peripheral flange 53. When engaged with the second wall 17, the shaft receiving section 55 extends through the second aperture 13*b* with the peripheral flange 53 abutting an inner surface 17*a* of the second wall 17. The shaft receiving section 55 is opened in the gas conduit and the second shaft 34 can extend therethrough. In the embodiment shown, at least a section of an outer surface of a peripheral wall of the shaft receiving section 55 extending from the peripheral flange 53 of the inner member 52 of the second aperture closing unit 50 comprises threads (not shown). The outer member 54 includes an inner threaded aperture and is screwable onto the outer surface of the shaft receiving section 55 from outside of the gas conduit of the duct 12, such as to press the peripheral flange 53 towards the inner surface 17*a* of the second wall 17. When engaged together, the aperture of the outer member 54 is concentric with the shaft receiving aperture of the inner member 52. With the second shaft 34 extending in the shaft receiving section, each one of the inner member 52 and the outer member 54 are pressed against the second wall 17 in order to provide the closure. Moreover, the inner member 52 and the outer member 54 are tightly engaged around the second shaft 34 such as to provide closure of the second aperture 13*b* in the vicinity of the second shaft 34 extending therethrough and having a section extending outside of the gas conduit of the duct 12.

In an embodiment, the second aperture closer 50 also includes a sleeve 57 extending into the shaft receiving section 55, or shaft receiver. The second aperture closer sleeve 57 is again shaped and sized to tightly fit around the second shaft 34 to be received therein and is made of wear resistant and/or low friction coefficient material, such as copper or the like. In an embodiment, a lubricant, such as grease or the like can be provided inside the second aperture closer sleeve 57 to reduce friction between the inner surface of the sleeve and the second shaft 34 received therein. In an alternative embodiment, the inner surface of the peripheral wall of the shaft receiver 55 can be made of or lined with a resistant and/or low friction coefficient material.

One skilled in the art will once again understand that the configuration and shape of the second aperture closing unit 50 can vary from the embodiment shown. Once again, in an embodiment, the second aperture closing unit 50 offers closure of the second aperture 13*b* in compliance with regulatory security standards, such as NFPA 96, and allows the shaft 30 to rotatably extend therethrough.

One skilled in the art will understand that, in an alternative embodiment, an aperture closing unit such as the one described above can also be used to close the first aperture 13*a* instead of the plug 41 described above in connection with the first aperture closing unit 40. In such an embodiment, each one of the first shaft 32 and the second shaft 34 have a section extending outside of the gas conduit of the duct 12.

In an embodiment, the at least one damper blade of the damper 10 is rotatable between a plurality of modulating configurations inside the duct 12, in order to regulate the airflow therein.

In embodiments where the at least one damper blade of the damper 10 is rotatable between a plurality of modulating configurations inside the duct 12, the first shaft 32 remains rotatable when engaged with the plug 41, in order to allow the rotation of the damper 10 between the plurality of modulating configurations. In an embodiment, the first shaft 32 can rotate within the plug 41 and, in an alternative embodiment, the plug 41, or a portion thereof, can rotate with the first shaft 32. In an embodiment, the plug 41 includes a bearing assembly (not shown), which allows the rotation of a section thereof and therefore allows the above-mentioned rotation of the first shaft 32 engaged therewith. Similarly to the first shaft 32, the second shaft 34 is rotatable when engaged with the second aperture closing unit 50. In an embodiment, the second shaft 34 can rotate within the second aperture closing unit 50 and, in an alternative embodiment, the second aperture closing unit 50, or a portion thereof, can rotate with the second shaft 34. In an embodiment, the second aperture closing unit 50 includes a bearing assembly (not shown) in order to allow the rotation of a section thereof and thereby provide the above-mentioned rotation of the second shaft 34 engaged therewith.

In the embodiment shown, the second shaft 34 is operatively connected to an actuation system 60, such as a motor, located outside of the gas conduit of the duct 12. The actuation system 60 is operative to rotate the second shaft 34 and therefore move the damper blades 14, 16 between the plurality of modulating configurations. In an embodiment, the actuation system 60 can be operatively connected to and controlled by a control unit (not shown). It will be understood that, in an embodiment where multiple dampers 10 are provided (not shown), a connecting mechanism can be provided between the shaft 30 of each damper 10 to control the rotation of each shaft 30 such that the multiple dampers 10 rotate in a coordinated way between the plurality of modulating configurations. In another alternative embodiment, multiple coordinated actuation systems 60 can also be provided.

One skilled in the art will understand that, in an alternative embodiment (not shown), the damper 10 can be free of actuation system 60. In such an embodiment, the shaft 30 extending through the duct 12 can be manually rotatable in order to allow manual control of the damper 10. For example and without being limitative, in an embodiment, the shaft 30 can be connected to a handle outside of the gas conduit of the duct 12, which is operable to manually adjust the damper 10 between the plurality of modulating positions. In an embodiment, the handle can be locked in position, once the desired modulating position is manually reached. In another alternative embodiment, the at least one damper blade of the damper 10 can also be non-rotatable, such as to remain in the same position inside the duct, and provide a constant flow regulation inside the duct 12.

In an embodiment, a damper kit including a damper 10 such as the one described above, as well as the first aperture closing unit 40 for closing the first aperture 13*a* and the second aperture closing unit 50 for receiving a section of a shaft 30 therethrough and closing the second aperture 13*b* can be provided. The damper kit can be used for installing the damper 10 to an existing duct 12 by making only two apertures in opposite walls of the existing duct 12.

The damper 10 and damper kit according to an embodiment having been described above, a method for installing the damper 10 in a duct 12 will be described below.

According to an embodiment, the method comprises a first step of making a first aperture 13*a* in a first wall 15 of the duct 12 and a second aperture 13*b* in a second opposed wall 17 of the duct 12, for example by piercing. For instance, the apertures 13*a*, 13*b* can be made with a knock-out punch, or the like. The first aperture 13*a* and the second aperture 13*b* are substantially aligned such that the damper 10 which will be installed using the first aperture 13*a* and the second aperture 13*b* is substantially evenly leveled relative to the duct 12.

Once the apertures 13*a*, 13*b* have been made, the first aperture closing unit 40, for example the plug 41, is engaged in the first aperture 13*a* defined in the first wall 15. As described above, in an embodiment, the plug 41 is engaged and secured to the first wall 15 by inserting the plug 41 in the first aperture 13*a*, pressing the peripheral flange 43 of the plug 41 against the inner surface 15*a* of the first wall 15, around the first aperture 13*a*, and engaging a securing member 44 to the outer surface of the shaft receiving section 42 of the plug 41 from outside of the gas conduit of the duct 12.

The damper 10 is subsequently positioned in the duct 12. In an embodiment, the damper 10 is positioned in the duct 12 by firstly introducing the damper 10 in the duct 12 in the contracted configuration, inserting a section of shaft 30 through the second aperture 13*b* and subsequently configuring the damper 10 in the operative configuration such that one end section 33 of the shaft 30 is introduced in the shaft receiving cavity 46 of the plug 41.

In an embodiment where the damper 10 comprises a single damper blade substantially spanning the width of the duct 12, the step of positioning the damper 10 in the duct 12 can rather comprise the steps of introducing the damper 10 in the duct 12 and sliding a shaft 30 through the second aperture 13*b* and into a shaft receiving section of the damper blade until an end section 33 of the shaft 30 is introduced in the shaft receiving cavity 46 of the plug 41.

In an alternative embodiment, the damper 10 can also be secured to the shaft, subsequently to the shaft being secured in place. For example and without being limitative, the damper 10 can be clipped onto the shaft to allow easy removal therefrom, without requiring the shaft to be removed from the apertures.

In another alternative embodiment, the damper 10 can be inserted in the duct and a section of shaft already connected to the damper 10 can be introduced in the shaft receiving cavity 46 of the plug 41. Subsequently, a shaft 30 can be inserted through the second aperture 13*b* and into a shaft receiving section of the damper blade to secure the damper 10 relative to the second aperture 13*b*.

In order to provide the second aperture closing unit 50 for closing the second aperture 13*b* through which the shaft 30 extends, in an embodiment, the inner member 52 is engaged with the shaft 30, inside the duct 12, prior to the shaft being engaged through the second aperture 13*b* and the outer member 54 is engaged with the shaft 30, outside of the gas conduit of the duct 12, once the shaft 30 projects therefrom. Subsequently, the inner member 52 and outer member 54 are respectively engaged with and secured to the inner surface 17*a* and the outer surface 17*b* of the second wall for partially covering the second aperture 13*b*, with a section of the shaft 30 extending therethrough.

In an embodiment, the damper 10 can subsequently be connected to the actuation system 60, such as a motor, which is operative to rotate the shaft 30 and move the damper 10 between the plurality of modulating configurations. As previously mentioned, in an embodiment, no actuation system 60 can be provided, this step thereby being omitted.

It will be appreciated that alternatives can be foreseen to the above described method. Furthermore, it will be appreciated that the method described herein can be performed in the described order, or in any suitable order.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments can be provided in any combination with the other embodiments disclosed herein. It is understood that the invention can be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A damper kit for installing a damper in a duct having at least one conduit wall and defining a gas conduit, the at least one conduit wall having a first aperture and a second aperture extending through the at least one conduit wall, the damper kit comprising:

a first aperture closer engageable with the at least one conduit wall and comprising a first shaft receiver and a first aperture closer sleeve, the first shaft receiver having a peripheral wall defining a shaft receiving cavity opened in the gas conduit and a peripheral flange extending peripherally and outwardly of the peripheral wall at an open end of the first shaft receiver, the peripheral flange abutting against an inner surface of the at least one conduit wall when engaged therewith, the first aperture closer sleeve being made of a first wear resistant material and extending in the shaft receiving cavity of the first shaft receiver to at least partially line the peripheral wall thereof, the first aperture closure sleeve comprising a peripheral flange abutting against the peripheral flange of the first shaft receiver when inserted in the shaft receiving cavity thereof;

a second aperture closer engageable with the at least one conduit wall and comprising a second shaft receiver and a second aperture closer sleeve, the second shaft receiver having peripheral wall defining a shaft receiving cavity opened in the gas conduit and a peripheral flange extending peripherally and outwardly of the peripheral wall at an open end of the second shaft receiver, the peripheral flange abutting against the inner surface of the at least one conduit wall when engaged therewith, the second aperture closer sleeve extending in the shaft receiving cavity of the second shaft receiver to at least partially line the peripheral wall thereof, the second aperture closer sleeve being made of a second wear resistant material, the second aperture closure sleeve comprising a peripheral flange abutting against the peripheral flange of the second shaft receiver when inserted in the shaft receiving cavity thereof;

the damper having at least one shaft with a first section insertable in the aperture closer sleeve of the first aperture closer and a second section insertable in the second aperture closer sleeve extending in the second aperture closer, the at least one shaft extending past the at least one conduit wall through the second aperture closer, outwardly of the gas conduit, and the first and second aperture closer sleeves being sized and shaped to contact and surround respectively the first and second sections of the at least one shaft and to prevent direct contact between the first and second sections of the at least one shaft and the peripheral walls of the shaft receivers of the first and second aperture closers and to close respectively the first and second apertures when the first and second aperture closers are engaged with the at least one conduit wall, with the first and second sections of the at least one shaft inserted in the first and second aperture closer sleeves;

wherein the damper comprises at least a first damper blade and a second damper blade slidably engageable with one another and configurable in a contracted configuration and a plurality of extended configurations; and wherein each one of the first damper blade and the second damper blade comprises a protruding male member and each one of the first damper blade and the second damper blade comprises an elongated slot, the protruding male member being insertable and slidable in the elongated slot of the other one of the first damper blade and the second damper blade with the first damper blade and the second damper blade being securable in one of the plurality of extended configurations.

2. The damper kit of claim 1, wherein the first shaft receiver of the first aperture closer further comprises an end wall extending inwardly from the peripheral wall, at a closed end of the first shaft receiver, opposed to the open end.

3. The damper kit of claim 1, wherein the first aperture closer further comprises a fastener screwable onto an outer surface of the peripheral wall of the first shaft receiver of the first aperture closer, outwardly of the gas conduit, and superposable against an outer surface of the at least one conduit wall, outside of the gas conduit, to press the peripheral flange of the first shaft receiver of the first aperture closer against the inner surface of the at least one conduit wall.

4. The damper kit of claim 3, wherein the at least one shaft also extends past the at least one conduit wall through the first aperture closer, outwardly of the gas conduit.

5. The damper kit of claim 1, wherein the first aperture closer sleeve extends into the first shaft receiver of the first aperture closer, along a majority of a length of the peripheral wall thereof.

6. The damper kit of claim 1, wherein the first damper blade comprises a first shaft including the first section insertable in the first shaft receiver of the first aperture closer and the second damper blade comprises a second shaft including the second section insertable in the second shaft receiver of the second aperture closer.

7. The damper kit of claim 1, wherein the second aperture closer sleeve extends into the second shaft receiver of the second aperture closer, along a majority of a length of the peripheral wall thereof.

8. The damper kit of claim 1, wherein the second shaft receiver of the second aperture closer is opened at both ends, and the second aperture closer further comprises an outer member screwable onto an outer surface of the peripheral wall of the second shaft receiver of the second aperture closer, outwardly of the gas conduit, and superposable against an outer surface of the at least one conduit wall, outside of the gas conduit, to press the peripheral flange of the second shaft receiver of the second aperture closer against the inner surface of the at least one conduit wall.

9. The damper kit of claim 1, wherein the at least one shaft of the damper is rotatably engaged with the first aperture closer and the second aperture closer, and wherein the damper kit further comprises an actuation system operatively connectable to a section of the at least one shaft of the damper extendable through the second aperture closer.

10. The damper kit of claim 1, wherein the first wear resistant material and the second wear resistant material are the same material.

11. The damper kit of claim 1, wherein the first wear resistant material and the second wear resistant material are copper-based.

* * * * *